US007530892B2

(12) United States Patent
Jordan et al.

(10) Patent No.: US 7,530,892 B2
(45) **Date of Patent: *May 12, 2009**

(54) VALUED END BONUS EVENT FOR GAMING MACHINE

(75) Inventors: Jeff Jordan, Las Vegas, NV (US); Richard J. Schneider, Las Vegas, NV (US); Scott A. Boyd, Las Vegas, NV (US); Glen K. Russell, Las Vegas, NV (US)

(73) Assignee: IGT, Reno, NV (US)

( * ) Notice: Subject to any disclaimer, the term of this patent is extended or adjusted under 35 U.S.C. 154(b) by 970 days.

This patent is subject to a terminal disclaimer.

(21) Appl. No.: 10/423,727

(22) Filed: Apr. 25, 2003

(65) Prior Publication Data

US 2004/0214627 A1 Oct. 28, 2004

(51) Int. Cl.
*A63F 9/24* (2006.01)

(52) U.S. Cl. ..... 463/20

(58) Field of Classification Search ..... None
See application file for complete search history.

(56) References Cited

U.S. PATENT DOCUMENTS 4,582,324 A * 4/1986 Koza et al. ..... 463/16
5,380,008 A * 1/1995 Mathis et al. ..... 463/18
5,456,465 A * 10/1995 Durham ..... 463/21
6,159,098 A * 12/2000 Slomiany et al. ..... 463/25
6,190,255 B1 * 2/2001 Thomas et al. ..... 463/20
6,346,043 B1 2/2002 Colin et al.
6,347,996 B1 2/2002 Gilmore et al.
6,464,581 B1 10/2002 Yoseloff et al.
6,481,713 B2 11/2002 Perrie et al.
6,482,089 B2 11/2002 DeMar et al.
6,485,366 B1 11/2002 Rowe
6,485,367 B1 11/2002 Joshi
6,599,185 B1 * 7/2003 Kaminkow et al. ..... 463/16
6,602,137 B2 * 8/2003 Kaminkow et al. ..... 463/16
6,776,711 B1 * 8/2004 Baerlocher ..... 463/16
6,796,900 B2 * 9/2004 Baerlocher et al. ..... 463/16
6,832,956 B1 * 12/2004 Boyd et al. ..... 463/19
6,860,811 B1 * 3/2005 Wilkins ..... 463/25
7,033,272 B1 * 4/2006 Mason ..... 463/25
2002/0010018 A1 * 1/2002 Lemay et al. ..... 463/20
2002/0045475 A1 * 4/2002 Glavich et al. ..... 463/20

(Continued)

FOREIGN PATENT DOCUMENTS

EP 0 945 837 A3 1/2001

(Continued)

*Primary Examiner*—Ronald Laneau
*Assistant Examiner*—Tramar Harper
(74) *Attorney, Agent, or Firm*—Armstrong Teasdale LLP

(57) ABSTRACT

The game bonus can be initiated by a reel symbol combination; an example is the initiator symbol that occurs on the base game. In the preferred implementation, the bonus initiator will be a scatter pay on a video slot. Upon hitting the initiator, the game random number generator chooses a value to award and an associated script to display the award based upon a probability and award schedule. The embodiments of display have a play choosing chickens located in cages on a truck. Each chicken awards a value until a chicken with a stopper and a value is chosen. This stopper ends the script and the player is awarded a value.

16 Claims, 11 Drawing Sheets

| Script # | Probability | Total Bonus (x bet) | Scatter Pay (x bet) |
|---|---|---|---|
| 1 | 30% | 20 | 5, 10, 5(S) |
| 2 | 20% | 16 | 3, 15(S) |
| 3 | 15% | 24 | 5, 5, 5, 9(S) |
| 4 | 10% | 30 | 10, 15, 5(S) |
| 5 | 10% | 12 | 12(S) |
| 6 | 5% | 26 | 6, 20(S) |
| 7 | 5% | 40 | 5, 10, 5, 15, 5(S) |
| 8 | 3% | 55 | 40, 5, 10(S) |
| 9 | 2% | 200 | 5, 10, 10, 15, 5, 20, 15, 25, 12, 3, 15, 15, 50(S) |

| | | | | |
|---|---|---|---|---|
| A | B | C | D | E |
| F | G | H | I | J |
| K | L | M | N | O |
| P | Q | R | S | T |
| U | V | W | X | Y |

U.S. PATENT DOCUMENTS

| | | | | |
|---|---|---|---|---|
| 2002/0049084 | A1* | 4/2002 | Hughs-Baird et al. | 463/20 |
| 2003/0064792 | A1* | 4/2003 | Baerlocher et al. | 463/25 |
| 2003/0078093 | A1* | 4/2003 | Simms et al. | 463/20 |
| 2003/0162583 | A1* | 8/2003 | Baerlocher et al. | 463/20 |
| 2003/0224857 | A1* | 12/2003 | Baerlocher | 463/42 |
| 2004/0053682 | A1* | 3/2004 | Nelson et al. | 463/25 |
| 2004/0214628 | A1* | 10/2004 | Boyd et al. | 463/20 |

FOREIGN PATENT DOCUMENTS

| | | | |
|---|---|---|---|
| EP | 1 298 607 | A3 | 5/2004 |
| GB | 2384720 | | 8/2003 |
| GB | 2387010 | | 10/2003 |
| WO | 98/51383 | | 11/1998 |
| WO | WO 01/99067 | | 12/2001 |

* cited by examiner

| Script # | Probability | Total Bonus (x bet) | Scatter Pay (x bet) |
|---|---|---|---|
| 1 | 30% | 20 | 5, 10, 5(S) |
| 2 | 20% | 16 | 3, 15(S) |
| 3 | 15% | 24 | 5, 5, 5, 9(S) |
| 4 | 10% | 30 | 10, 15, 5(S) |
| 5 | 10% | 12 | 12(S) |
| 6 | 5% | 26 | 6, 20(S) |
| 7 | 5% | 40 | 5, 10, 5, 15, 5(S) |
| 8 | 3% | 55 | 40, 5, 10(S) |
| 9 | 2% | 200 | 5, 10, 10, 15, 5, 20, 15, 25, 12, 3, 15, 15, 50(S) |

FIG. 13

| | | | | |
|---|---|---|---|---|
| A | B | C | D | E |
| F | G | H | I | J |
| K | L | M | N | O |
| P | Q | R | S | T |
| U | V | W | X | Y |

FIG. 14

| | | | | |
|---|---|---|---|---|
| A | B | C | D | E |
| F | G | H | I | J |
| K | L | M | N | O |
| 50 coins | Q | R | S | T |
| U | V | W | X | Y |

FIG. 15

| | | | | |
|---|---|---|---|---|
| A | B | C | D | E |
| F | G | H | I | J |
| K | L | M | N | O |
| 50 coins | Q | R | S | 75 coins |
| U | V | W | X | Y |

FIG. 16

| | | | | |
|---|---|---|---|---|
| A | B | C | D | E |
| F | G | 25 coins (stopper) | I | J |
| K | L | M | N | O |
| 50 coins | Q | R | S | 75 coins |
| U | V | W | X | Y |

VALUED END BONUS EVENT FOR GAMING MACHINE

BACKGROUND OF THE INVENTION

1. Field of the Invention

This invention relates generally to electronic gaming machines and more particularly to a method and apparatus for operating a gaming machine special feature that terminates on a positive result.

2. Description of the Prior Art

Casinos typically include electronic gaming machines (EGMs) such as slot machines and video poker machines. Slot machines, for example, usually include three reels that each have a plurality of symbols printed thereon. After the player applies a wager to the machine, he or she starts play by triggering a switch that starts the reels spinning. Each reel stops at a random position and thereby presents three symbol—one from each reel. Some combinations of symbols do not pay any jackpot. Others pay varying amounts according to predetermined combinations that appear in a pay table displayed on the machine and stored in the gaming machine's programmable read-on memory (PROM).

Competition for players among electronic gaming machines is tight and the industry is developing different methods for attracting and keeping players at their machines. One method for attracting players is to create linked progressive jackpot systems in which multiple gaming machines have been linked together into groups of machines that share the same bonus pool. A simple example of such a system is progressive video poker in which players play the primary poker game on one of a plurality of gaming machines grouped together on the casino floor. A coin-in counter, linked to all machines sharing the progressive pool, counts the total amount of money played in the group of machines and advances the progressive bonus pool accordingly. For instance, the casino can choose to set aside 5% of all money played on the group of video poker machines to the bonus pool. The amount of the pool is displayed on a large LED display and is incremented as money is played. This amount is awarded automatically as a bonus should a player on one of the video poker machines receive a designated winning hand such as a royal flush. After the bonus is awarded, the bonus pool is seeded with a nominal amount that is further incremented as described above.

The advantage of the progressive system is that the bonus pools from individual machines can be pooled to form larger awards that in turn attract more players. When taken to the extreme, progressive bonuses can be pooled together not only from machines in different areas of the casino, but also from different casinos in different states. More complex examples for bonusing are implemented using bonus servers over a network, such as disclosed in co-owned U.S. Pat. No. 6,319,125 (the '125 patent), which is incorporated herein by reference for all purposes. Also incorporated herein by reference for all purposes is U.S. Patent No. 5,655,961, assigned to the Assignee of the present application (the '961 patent), which also discloses bonuses that can be implemented by bonus servers over a network.

While these linked progressive systems have been effective at drawing additional players, there is a need for gaming machines that have additional attraction features and yet are not required to be linked to other machines. It is desired that the additional attraction feature include a positive ending result.

SUMMARY OF THE INVENTION

The current invention is intended to provide a novel secondary game feature that can be played in addition to the base primary game. The preferred embodiment is described in association with a slot machine, although it is understood that any base game can be used.

One method of operating a gaming machine involves receiving a wager and indicating, under control of a processor, a special feature of chance on a visual display, the visual display initially depicting an assemblage of selectable elements. The machine receives successive selections of the elements and ends the special feature upon a stop-selection outcome associated with at least one of the selectable elements. The bonus is awarded based on the elements selected including the elements associated with the stop-selection outcome.

Alternately, the method for operating a gaming machine under control of a processor operable in a bonus mode involves displaying a plurality of selection elements for selection, a nonpredetermined one of said elements being associated with both a value and a stop-selection outcome. The gaming machine then receives element selections and accumulates a value associated with those elements selected in a counter until selection of the element associated with the stop-selection outcome. The accumulated value is then awarded to the player as a bonus on top of payout from the base game.

The special feature for a gaming machine contemplated here is controlled by a processor in response to a wager. The special feature is indicated on a visual display and comprises a plurality of bonus scripts stored in a memory of the gaming machine. The special feature further includes a script selection means for selecting one of the bonus scripts responsive to the special feature. Each such script designates a total bonus amount, a total number of selection steps within a bonus sequence, and an apportionment value applied to each step of the sequence where a last step of the sequence is associated with a positive value. The special feature includes a visual display on which is displayed a plurality of selectable elements which are valued according to the selected script where each of the selectable elements does not have a value until the elements is selected during the special feature. The special feature additionally includes means for awarding the total bonus amount designated by the script.

The foregoing and other objects, features and advantages of the invention will become more readily apparent from the following detailed description of a preferred embodiment of the invention that proceeds with reference to the accompanying drawings.

BRIEF DESCRIPTION OF THE DRAWINGS

FIG. 13 illustrates a sample script probability table used in a preferred embodiment of the invention to choose and then implement the bonus script selected.

FIGS. 14-17 are schematic diagrams illustrating a scatter pay sequence implemented using a script selected from the table in FIG. 13.

FIG. 18 is an enlarged view of the display screen depicted in FIG. 9 with pictorial images displayed thereon from the schematic of FIG. 17 according to a preferred embodiment of the invention.

DETAILED DESCRIPTION

Figure 1:
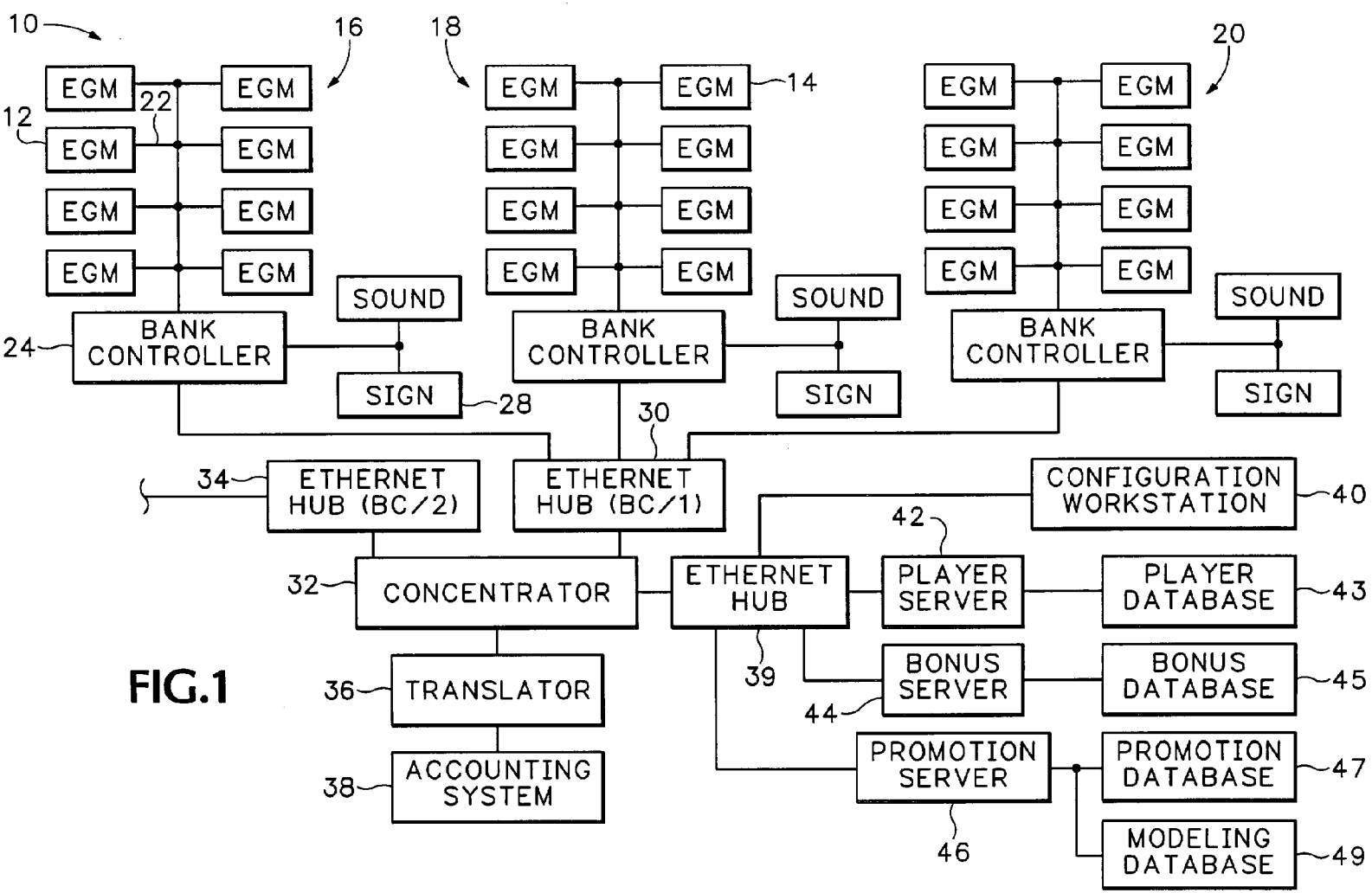
FIG. 1 is a schematic diagram of a plurality of electronic gaming machines interconnected by a computer network to a host computer in accordance with a networked embodiment of the present invention.

Turning now to FIG. 1, indicated generally at 10 is a schematic diagram illustrating electronic gaming machines (EGMs), like EGMs 12, 14, interconnected by a computer network. Included therein are three banks, indicated generally at 16, 18, 20, of EGMs. Each EGM is connected via a network connection, like connection 22, to a bank controller 24. In the present embodiment of the invention, each bank controller comprises a processor that facilitates data communication between the EGMs in its associated bank and the other components on the network. The bank controller may also include a CD ROM drive for transmitting digitized sound effects, such as music and the like, to a speaker 26 responsive to commands issued over the network to bank controller 24. The bank controller may also be connected to an electronic sign 28 that displays information, such as jackpot amounts and the like, visible to players of machines on bank 16. Such displays are generated and changed responsive to commands issued over the network to bank controller 24. Each of the other banks 18, 20 of EGMs include associated bank controllers, speakers, and signs as shown, which operate in substantially the same manner.

Ethernet hub 30 connects each of the bank controllers associated with banks 16, 18, 20 of EGMs to a concentrator 32. Another Ethernet hub 34 connects similar bank controllers (not shown), each associated with an additional bank of EGMs (also not shown), to concentrator 32. The concentrator functions as a data control switch to route data from each of the banks to a translator 36. The translator comprises a compatibility buffer between the concentrator and a proprietary accounting system 38. It functions to place all the data gathered from each of the bank controllers into a format compatible with accounting system 38. The present embodiment of the invention, translator 38 comprises an Intel Pentium 200 MHz Processor operating Microsoft Windows NT 4.0.

Another Ethernet hub 39 is connected to a configuration workstation 40, a player server 42, a bonus server 44 and a promotion server 46. Hub 39 facilitates data flow to or from the configuration workstation 40 and the servers 42, 44, and 46. Additionally, the servers 42, 44, and 46 communicate through the concentrator 32 to the bank controllers 24, which, in turn, communicate with the particular gaming devices 12.

The configuration workstation 40 has a user interface that allows portions of the network 10 and the servers 42, 44, and 46 to be set up and modified. The configuration workstation 40 could include a personal computer having a keyboard, monitor, microprocessor, memory, an operating system, and a network card coupled to the Ethernet hub 30.

The player server 42 includes a microcomputer that is used to track data of players using the gaming devices 12. The player server 42 is coupled to a player database 43 where the player tracking data is stored. Another function of the player server 42 is to control messages that appear on display 58 associated with each gaming device 12 and the messages on the signs 28 coupled to the bank server 24. The player server 42 may be embodied in a microcomputer including, for instance an Intel Pentium Processor, Microsoft operating system and a network card to couple the server to the Ethernet hub 39.

The bonus server 44 is embodied by a microcomputer and is used to control bonus applications or bonus systems on the gaming network 10. The bonus server 44 is coupled to a database 45 where bonus data is stored. The bonus server 44 implements includes a set of rules for awarding jackpots in excess of those established by the winning pay tables of each gaming device 12. Some bonus awards may be made randomly, while others may be made to link to groups of gaming devices 12 operating in a progressive jackpot mode. Specific examples of such bonuses and networks used to implement them include those as described in U.S. patents mentioned above and previously incorporated, as well as the various implementations described further below.

The promotion server 46 is coupled to a promotion database 47 and a modeling parameters database 49. The promotion server 46 includes functions and processes operative to generate signals to cause a system award to be generated, and to communicate the generated system award to the particular gaming device 12 at which the player receiving the award can receive the award.

Data of different types of system and/or bonus awards and how and when the awards are generated can be stored in the promotion database 47. For instance, the text that is printed on an award, or bar-codes that are printed on the award ticket can be stored on the promotion database 47. Modeling parameters and data can be stored on the modeling parameters database 49. For instance, conditions that when satisfied cause a ticket to be generated can be stored on this database. Such data could include the number of hours a player must play at a requisite coin-in level to cause a complementary meal ticket to be awarded to the player. Many examples of system awards and parameters used to implement them are discussed in detail below.

In determining when to grant a bonus or system award, the promotion server 46 can access data stored anywhere on the network, such as: from any of the databases 43, 45, 47 and 49; from the configuration workstation 40; from the bank controller 24; from the accounting system 38; and from the bonus engine 50 on any or all of the gaming devices 12 coupled to the computer network 10. Additionally, the computer network 10 illustrated in FIG. 1 is only an example gaming network. Those skilled in the art will appreciate that embodiments of the invention can operate on any acceptable network, even if it differs from the one illustrated in FIG. 1.

When the promotion server 46 determines that an award should be generated, it sends appropriate signals to the bonus engine 50 of the appropriate gaming device 12 through the gaming network 12 to deliver the award. As discussed above, one such method of award delivery is to cause an award ticket to be printed for the player, but others such as points, cash back, a promotional coupons can also be contemplated. Examples of bonuses that can be implemented on the network are disclosed in a co-pending application, now co-owned U.S. Pat. No. 6,319,125 (the '125 patent), which is incorporated herein by reference for all purposes. This co-owned patent also describes in more detail features of the network, like that shown in FIG. 1, that may be used to implement the present invention. The '961 patent also discloses bonuses that can be implemented by bonus and promotional servers 44, 46 and a network that could be used to implement the present invention.

As used herein the term jackpot indicates an award made resulting from the pay table on one of the EGMs while the term bonus indicates an award that does not result from the machine's pay table. The '125 patent and '961 patent include many examples of bonuses.

The term award is intended to encompass any payment given to a player of one of the EGM's and includes both jackpots and bonuses.

Figure 2:
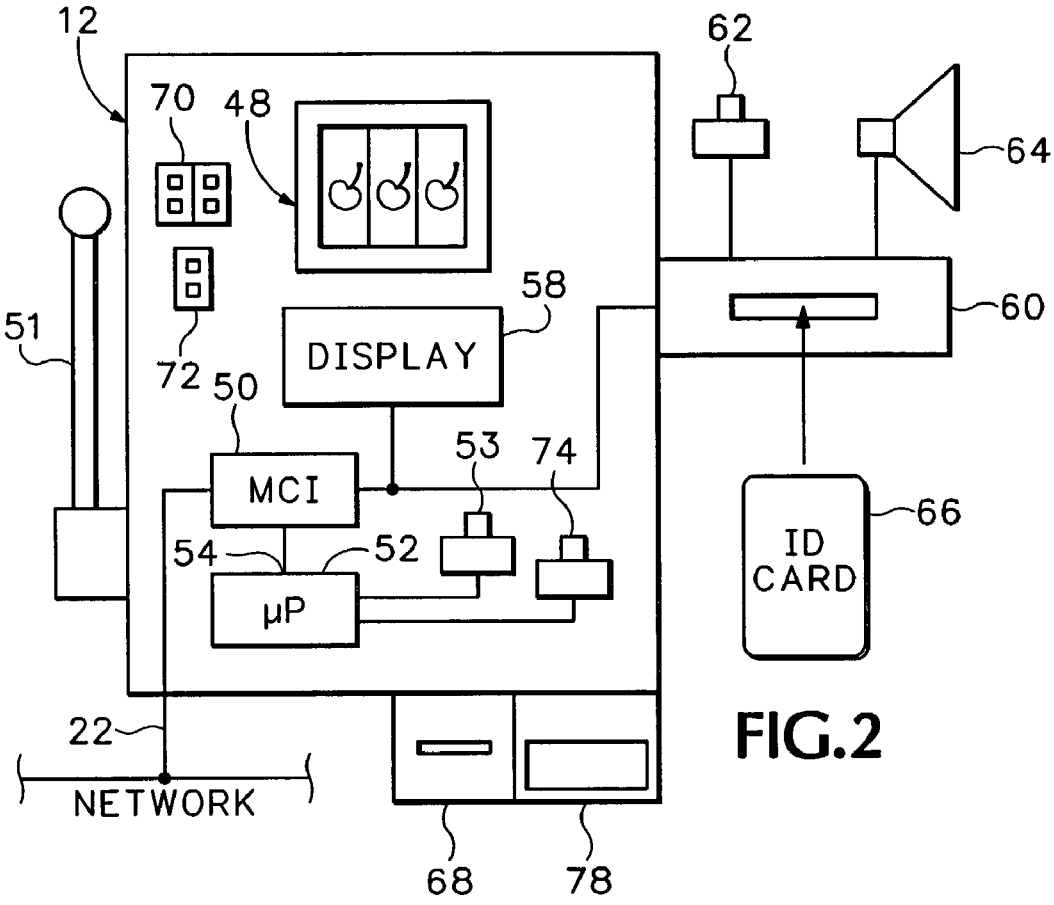
FIG. 2 is a schematic diagram of a slot machine and associated hardware, including the secondary bonus screen for displaying the bonus promotion implemented according to the invention.

FIG. 2 illustrates a gaming machine 12 constructed according to a preferred embodiment of the invention. Included is a highly schematic representation of an electronic slot machine—typical of each of the machines in the network—that incorporates network communications hardware as described hereinafter. This hardware is described in the '961 patent, and is referred to therein as a data communications node. Preferably the network communications hardware is like that disclosed in the '125 patent, namely a machine communication interface (MCI) 50.

MCI 50 facilitates communication between the network, via connection 22, and microprocessor 52, which controls the operation of EGM 12. This communication occurs via a serial port 54 on the microprocessor to which MCI 50 is connected.

Included in EGM 12 are three reels, indicated generally at 48. Each reel includes a plurality of different symbols thereon. The reels spin in response to a pull on handle 51 or actuation of a spin button 53 after a wager is made. In one specific implementation of the bonus, one or all of the reels 48 may include a special bonus initiator symbol which, when obtained on the gaming machine's payline, will cause the MCI 50 to initiate a secondary bonus game or other bonus event as described below.

MCI 50 includes a random access memory (RAM), which can be used as later described herein. The MCI also facilitates communication between the network and an liquid crystal display (LCD) or vacuum florescent display (VFD) 58, a card reader 60, a player-actuated push button 62, and a speaker 64.

Before describing play according to the invention, a description will first be made of typical play on a slot machine, like EGM 12. A player plays EGM 12 by placing a wager and then pulling handle 51 or depressing spin button 53. The wager may be placed by inserting a bill into a bill acceptor 68. A typical slot machine, like EGM 12, includes a coin acceptor that may also be used by the player to make a wager. Other elements incorporated into the electronic gaming machine 12 include a bill acceptor, coin-in meter, and a credit meter having a numeric display that indicates the total number of credits available for the player to wager. The credits are in the base denomination of the machine. For example, in a nickel slot machine, when a five-dollar bill is inserted into the bill acceptor, a credit of 100 appears on the credit meter. To place a wager, the player depresses a coin-in button, which transfers a credit from the credit meter to a coin-in meter. Each time the button is depressed a single credit transfers to the coin-in meter up to a maximum bet that can be placed on a single play of the machine. In addition, a maximum-bet button may be provided to immediately transfer the maximum number of credits that can be wagered on a single play from the credit meter to the coin-in meter.

When coin-in meter reflects the number of credits that the player intends to wager, the player depresses spin button 53 thereby initiating the base game.

The player may choose to have any jackpot won applied to credit meter 70. When the player wishes to cash out, the player depresses a cash-out button 74, which causes the credits on meter 70 to be paid in coins to the player at a hopper 78, which is part of machine 12. The machine consequently pays to the player, via hopper 78, the number of coins—in the base denomination of the machine—that appear on credit meter 70.

Card reader 60 reads a player-tracking card 66 that is issued by the casino to individual players who choose to have such a card. Card reader 60 and player-tracking card 66 are known in the art, as are player-tracking systems, examples being disclosed in the '961 patent and '125 patent. Briefly summarizing such a system, a player registers with the casino prior to commencing gaming. The casino issues a unique player-tracking card to the player and opens a corresponding player account that is stored on accounting system 38 (in FIG. 1). Accounting system 38 is referred to herein as a host computer. It should be appreciated, however, that the host computer can be distributed on the network and could include multiple processors or memories. The account includes the player's name and mailing address and perhaps other information of interest to the casino in connection with marketing efforts. Prior to playing one of the EGMs in FIG. 1, the player inserts card 66 into reader 60 thus permitting accounting system 38 to track player activity, such as amounts wagered and won and rate of play.

Turning next to FIGS. 3-6, indicated generally at 80 is the upper portion of slot machine 12. The slot machine is a commercially available electronic gaming device that has been modified as described herein.

Figure 9:
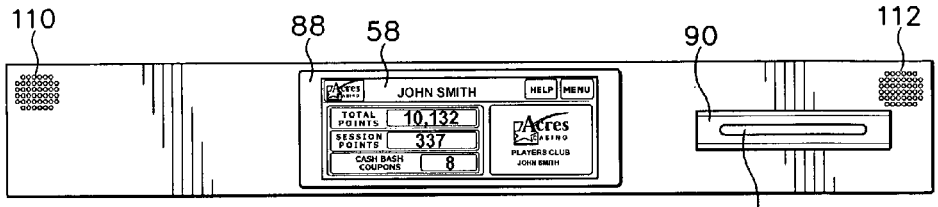
FIG. 9 is a view of the display and card reader on the slot machine of FIG. 3, including an image depicted on the display screen.

One aspect of the modifications to slot machine 12 includes addition of a bracket 82 mounted on the front of the slot machine. The bracket includes two openings, the first containing a 640×240 touch-panel liquid crystal display ("LCD") 58. In the present embodiment of the invention, LCD 58 comprises a Hitachi SX16H005-AZA LCD although it is of course possible to use other types of displays therein. The second opening 84, in FIG. 3, contains a card reader 60 having a slot 86 (visible in FIG. 9), into which a player's card is received as is known in the art. As shown in FIG. 9, both LCD 58 and slot 86 are framed by respective bezels 88, 90. Card reader bezel 90 and slot 86 are shown in FIG. 9.

Figure 3:
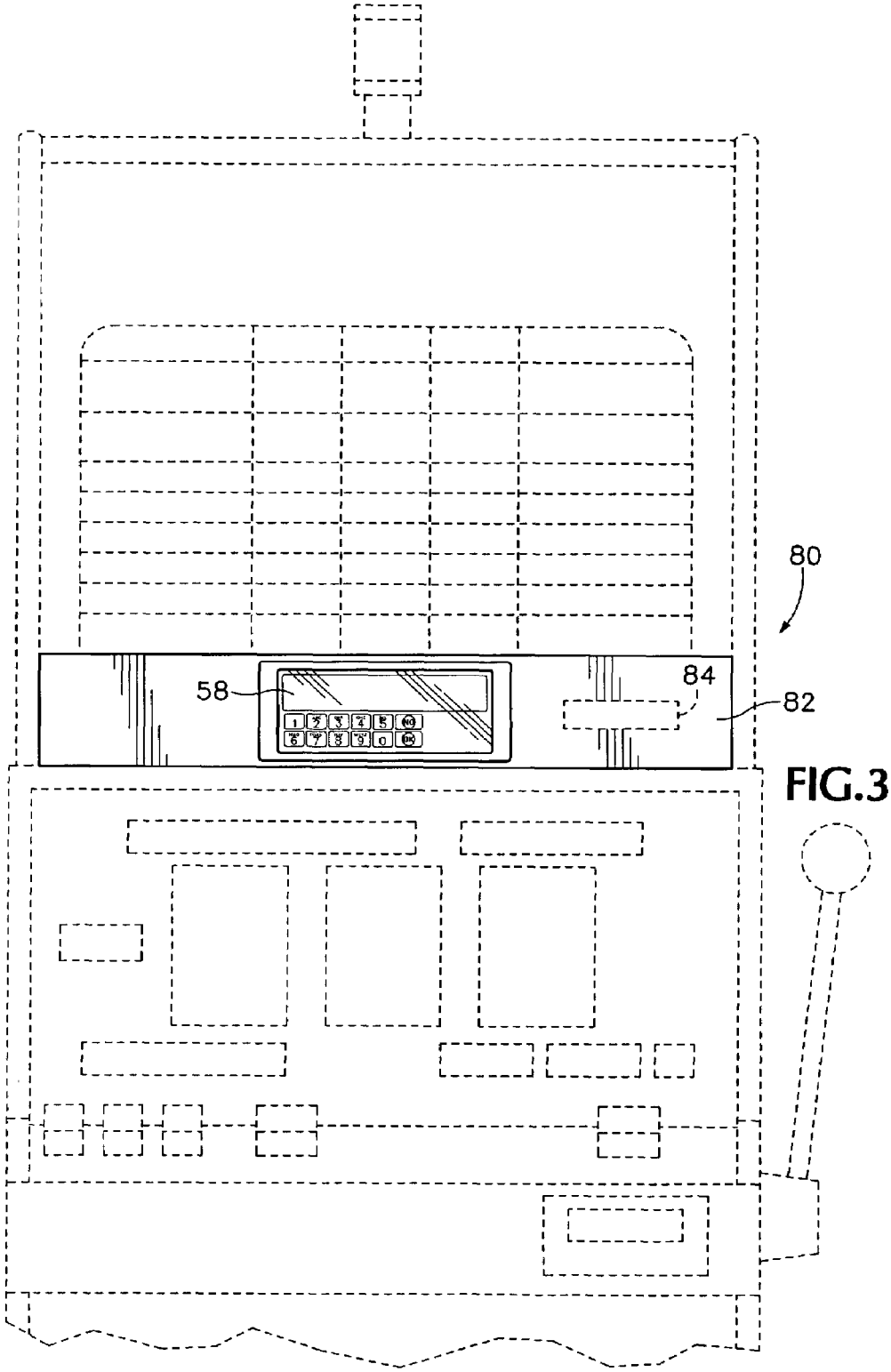
FIG. 3 is a partial view of a slot machine, shown in dashed lines, that is part of an implementation of the present embodiment of the invention, including an interactive display screen and card reader, shown in solid lines.
Figures 4, 5, 6:
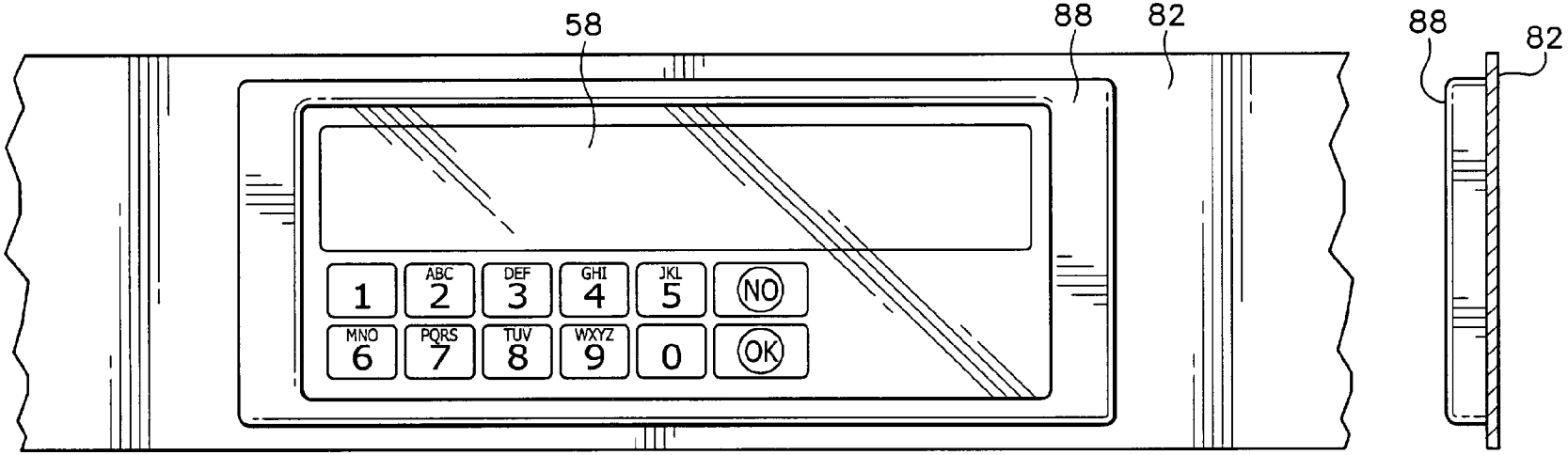
FIG. 4 is an enlarged partial view of the display of FIG. 3.
FIG. 5 is a right-side view of the display of FIG. 4.
FIG. 6 is a bottom view of the view of FIG. 4.
Figure 7:
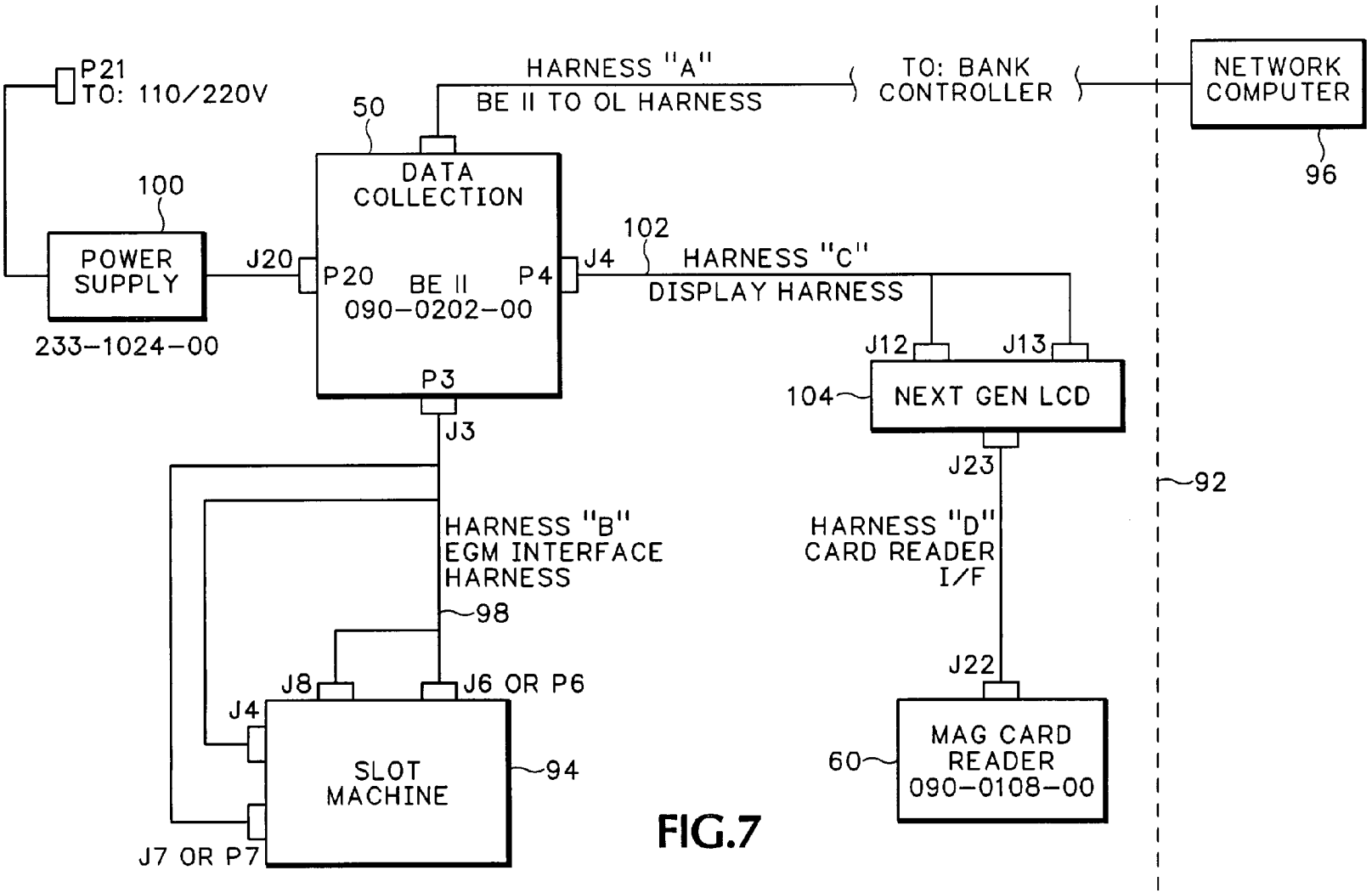
FIG. 7 is a schematic view of the slot machine display and card reader of FIG. 3 depicting the manner in which circuitry associated with each is connected to a network of similar slot machines incorporating displays and card readers.

Turning now to FIG. 7, the schematic components depicted therein on the left side of dashed line 92 are all contained within the cabinet that houses the upper portion 80 of slot machine 12 in FIG. 3. Slot machine electronics 94 is part of the original slot machine structure provided by the slot-machine manufacturer. The additional components on the left side of line 92, however, are all added to implement the invention in association with electronics 94 and the network.

The components within the slot machine, i.e., on the left side of line 92, are connected to a computer network, along with numerous additional slot machines 12, 14 having the related structure depicted in FIG. 7. The network is illustrated as a computer 96 on the right side of dashed line 92. Networked slot machines are known in the art and are depicted in the '961 and '125 patents. The network is shown generally in FIG. 1 and includes databases for storing slot machine transactions within accounting system 38 and player tracking data within player server 42, servers 44,46 for implementing system games and bonuses, and configuration work stations 40 for configuring the system games and bonuses. The network further includes a Content Manager, which is a program implemented on a network computer such as configuration work station 40 that permits an operator of the system, typically a casino, to customize and configure images that appear on display 58.

The slot-machine electronics 94 are connected to a system-machine interface (MCI) board 50 via a wiring harness 98. Board 50 provides communications between the slot machine electronics 94 and network 96 in a manner that is described in the '961 and '125 patents. A power supply 100 provides power to board 50. A wiring harness 102 connects board 50 with the display and associated electronics 104. Another harness connects board 50 to the network including computer 96. The power supply also supplies power to electronics 104 and to a card reader 60. The card reader is behind bezel 90 in FIG. 9 and includes slot 86.

Figure 8:
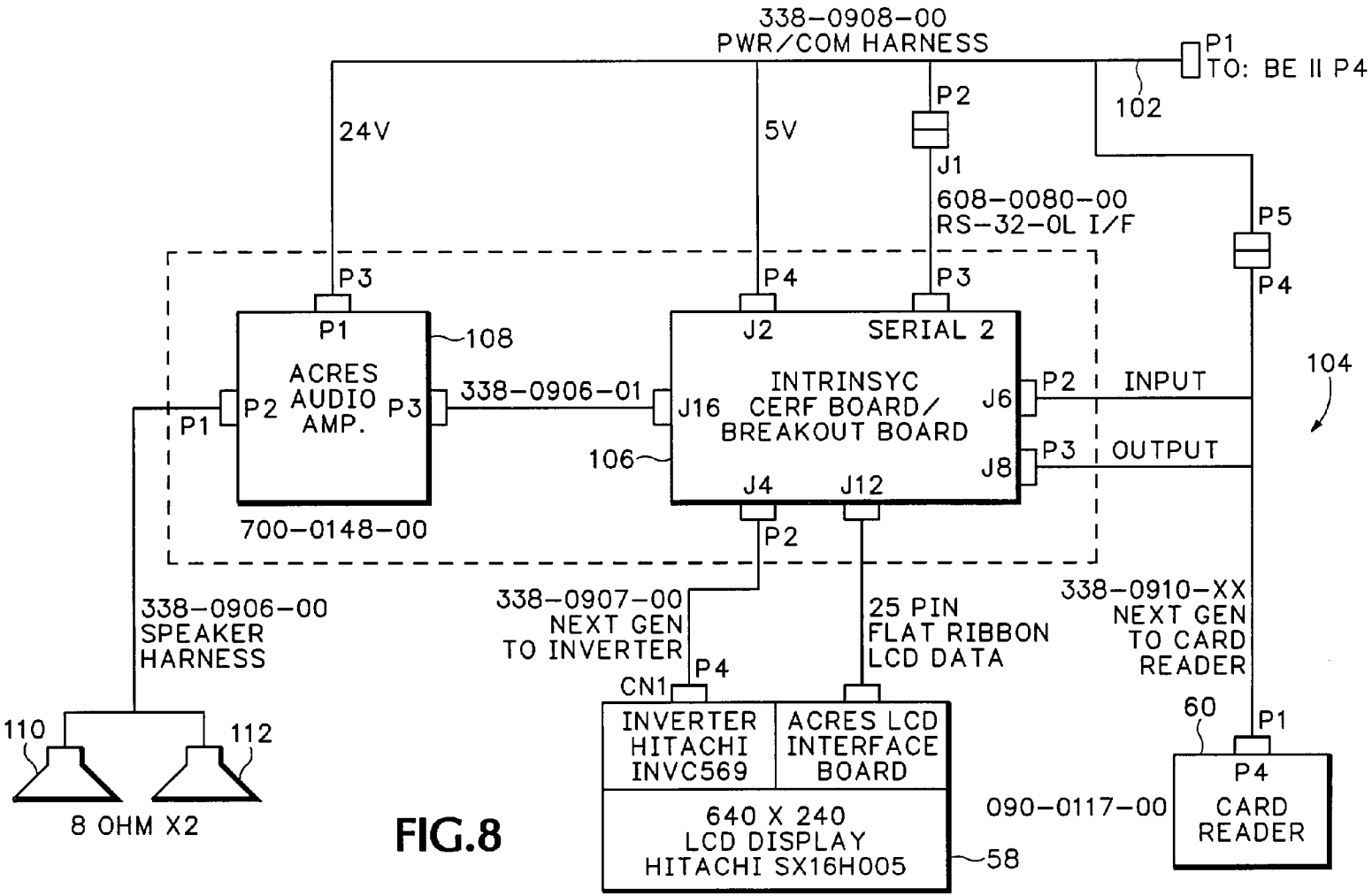
FIG. 8 is a schematic view of the display and related components of FIG. 7.

Turning now to FIG. 8, additional details of the display and associated electronics 104 in FIG. 7 are depicted schematically.

A dedicated computer 106 includes an LCD controller and electronics for enabling VGA touch panel images and sound for LCD 58. In the present embodiment of the invention, computer 106 is a commercially available processor board manufactured by Intrinsyc. It includes an Intel ARM processor and a Windows CE operating system. Computer 106 also includes nonvolatile memory for storing images and sounds that are utilized as described hereinafter. An amplifier 108 provides sound signals to speakers 110, 112, which are partially visible in FIG. 9. It is understood that the system electronics 104 can be wired by those knowledgeable in the art to also or instead utilize the base game speakers 64 (FIG. 2) rather than just dedicated speakers 110, 112.

In the present embodiment of the invention, the networked slot machines are initially configured using the Content Manager, which—in the present embodiment of the invention—runs on the same network PC platform as configuration work station 40 (FIG. 1), and enables files to be downloaded to the system-machine interface board, like board 50, associated with each slot machine. Once the screens and features of individual screens are selected at the Content Manager, an initialization file is created that identifies which MMC files and features have been selected. The configuration workstation can then be used to download the initialization file and associated MMC files to all the machines, to groups of machines, or even to a single selected machine. These initialization files and associated MMC files are stored in nonvolatile memory in electronics 104. All parameters associated with the audio content and with display 58 can be configured in this manner.

In operation of the prior art VFD, System Tokens—such as a player's name or accrued points—are embedded in a slot-machine message comprising otherwise constant text strings that appear on the VFD. For example in the message Hello Richard, Hello comprises a constant text string and Richard comprises the System Token, here, the player name associated with the player card in use.

In the present invention, an MMC Token is embedded in the prior art VFD message, which may includes System Tokens, that is transmitted to board 50 by the network and from there to board 106. As a result, if the message is received by a slot machine with a VFD, the usual VFD message is displayed. If it is received by a slot machine with an LCD, the MMC message identified by the MMC Token is called from storage in electronics 106 and run, incorporating any System Tokens as specified in the network message. But when a VFD message that does not include an MMC Token is received at an LCD machine, the FIG. 10 emulation screen appears bearing the VFD message in the upper half, and emulating a prior art keypad, which is associated with the VFD in prior art machines. This feature permits gradual introduction of LCD machines on a network and gradual introduction of MMC messages to any LCD machines that are on the network. Multimedia content can thus be downloaded on the gaming-machine network and displayed on the LCD as described above.

Figure 10:
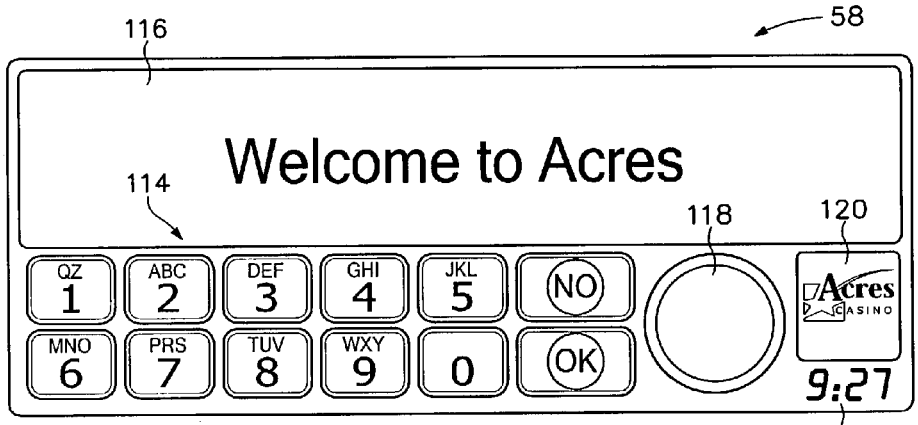
FIGS. 10-11 are enlarged views of the display screen depicted in FIG. 9 with images displayed thereon as described in the following detailed description.

In FIG. 10, display 58 is shown with an image that appears when the system emulates a prior art vacuum florescent display (VFD), like that disclosed in the '961 and '125 patents. The touch screen display image includes a keypad 114, a message screen 116, a bonus button 118, a casino logo 120, and a time display 122. Unless it is otherwise clear from the context, use of the term "button" herein refers to an image of a button on the touch screen, which enables a player to interact with the network by touching screen 58 over the button image. The casino operator has the option, implemented via the Content Manager, of displaying various features such as the bonus button and the system time, dependent upon the operator's preference.

Emulation mode is advantageous in two situations. First, if the touch screen display has not been configured, or configured incorrectly, the image of FIG. 10 appears. Second, when prior art systems are retrofitted to include some slot machines that incorporate the touch screen LCD of the present invention and others that incorporate the prior art VFD, there may be some network display messages that are not implemented with the multimedia content ("MMC") used by LCD 58. If so, the system defaults to VFD emulation mode, in which VFD messages are displayed on message screen 116, while the player enters commands using keypad 114 and bonus button 118. In this mode, touch keypad 114 and the message panel 116 emulate the behavior of the prior art VFD and keypad, respectively.

In another embodiment of the invention, a separate network, i.e., a different network from the one computer 50 is on, is connected to board 106. This separate network provides MMC to board 106 for displaying images or playing audio. Such a network could be used to deliver real-time multimedia content to the display 58 and speakers 110, 112. In addition, this network is used to deliver real-time video, either broadcast or closed circuit, to the display while play is ongoing. The keypad image on the touch screen display is used by the player to select a broadcast or closed-circuit channel. This configuration could permit a player to watch, e.g., a sporting event or other show while gaming.

Figure 11:
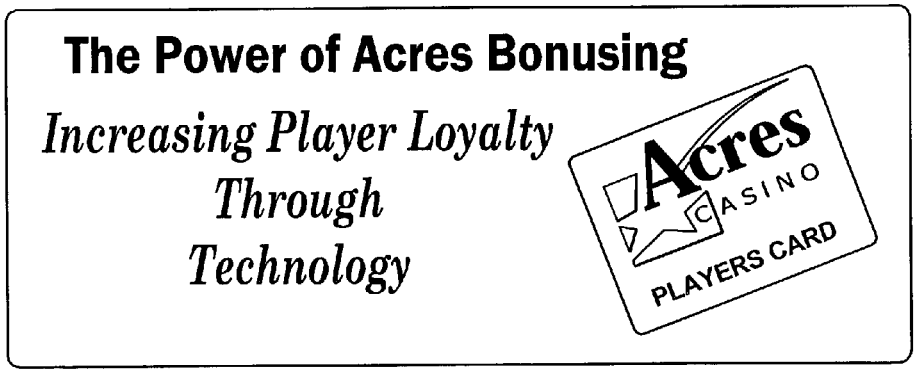

FIG. 11 depicts an example of display 58 in idle-attract mode, i.e., when there is no player card inserted in slot 86. When there is no card, the system displays up to 32 full size screens in a repeating sequence. Using a computer and keyboard on the network, the operator can control the duration, time of day, and sound associated with the idle-attract mode.

Figure 12:
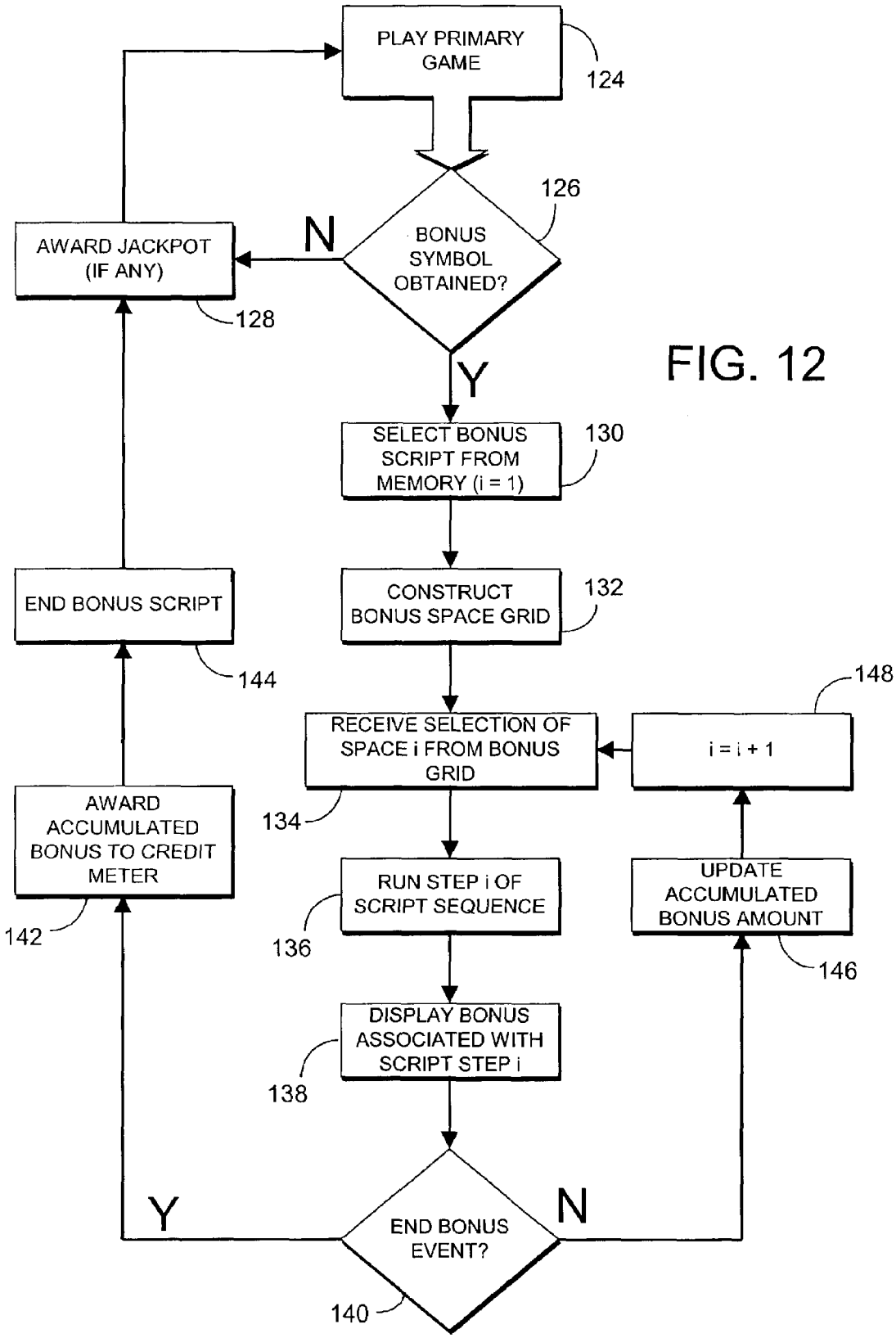
FIG. 12 is a flow diagram illustrating a method of operation of the gaming machine or machine network according to a preferred embodiment of the invention.

The secondary game is implemented as shown in FIG. 12, according to a preferred embodiment of the invention. In operation, the player plays the base game in block 124 and is paid in block 128 according to the pay table stored within the slot machine electronics 94 in that game. The gaming machine 12 receives a wager for play of the base game of one or more coins, credits, or points. The amount of such a wager is called a bet.

The base game has three reels 48, which—in each game—stop according to a random number generated for each reel. One (or more) of the reels includes a special symbol (or symbols) called an initiator symbol. The bonus controller 100 detects if that reel stops on the initiator symbol in block 126. If it does, the bonus controller 100 initiates a special feature in the form of a bonus game and delays the end of the base game. If no bonus symbol is obtained on any one of the reels 48, then the game proceeds to block 128 and the jackpot award from symbols corresponding to the paytable stored in the gaming machine electronics 94 (if any) are awarded to the players credit meter 70 (FIG. 2).

An initiator symbol on the payline of a gaming machine is but one method for implementing step 126 and one skilled in the art would recognize that any number of criteria could be used for initiating the bonus game. In one example, for instance, the special feature could be initiated under control of the gaming machine processor from a trigger message sent through the gaming machine network from promotion server 46 in conjunction with player database 43 indicating that the player has reached some betting threshold.

In a preferred implementation, the game incorporates a scripted bonus meaning once the initiator symbol is hit in block 126 then the game proceeds to block 130 in which one of a multiplicity of scripts is selected. The selected script takes the player through the predetermined bonus sequence within the bonus display 58. Each script includes one or more steps and requires player interaction in order to advance to the next step in the sequence.

FIG. 13 shows a table containing nine possible selectable scripts. While the scripts are preferably stored, selected, and operated within the gaming machine electronics 94, such scripts can be stored, selected, and operated across the gaming machine network shown in FIG. 1. The scripts shown are but representative of the type used in the preferred implementation of the bonus game and it is understood that different or additionally selectable scripts are possible.

The first column in FIG. 13 depicts the script number from 1 through 9.

The second column in FIG. 13 depicts the probability of selection associated with each of the scripts. These probabilities are precalculated and stored within the table to ensure that the amounts paid through the bonus game do not cause the game operators to lose money over time but rather are weighted by house odds to cover overhead for operating the machine. The nine scripts shown have a total probability of selection of 100%. Under control of gaming machine microprocessor 52 (FIG. 2), a random or pseudo-random number is generated to determine the script selected according to the probabilities associated with the scripts. A number of 1-30 out of 100 would result in selection of the first script (#1). A number of 31-50 would result in selection of the second script (#2). A number of 51-65 would result in selection of the third script (#3), and so on. Script #9 would be selected if the random number generated is either a 99 or 100 to reflect the 2% probability of selection associated with the script.

The third column in FIG. 13 depicts the total bonus awarded in the special feature—awarded in block 142 of the FIG. 12 flow diagram—as a function of the total amount bet. If five coins are wagered in a nickel machine, then the bet is twenty-five cents and the total bonus payable to the player is five dollars (20×$0.25) if script one is selected. If script #8 is selected by operation of the random number generator, then the total bonus awarded in block 142 is $13.75 (55×$0.25).

The fourth column in FIG. 13 depicts the amounts awarded in each step of the bonus script as a function of bet. Operation of the script is explained more fully below.

Figures 17, 18:
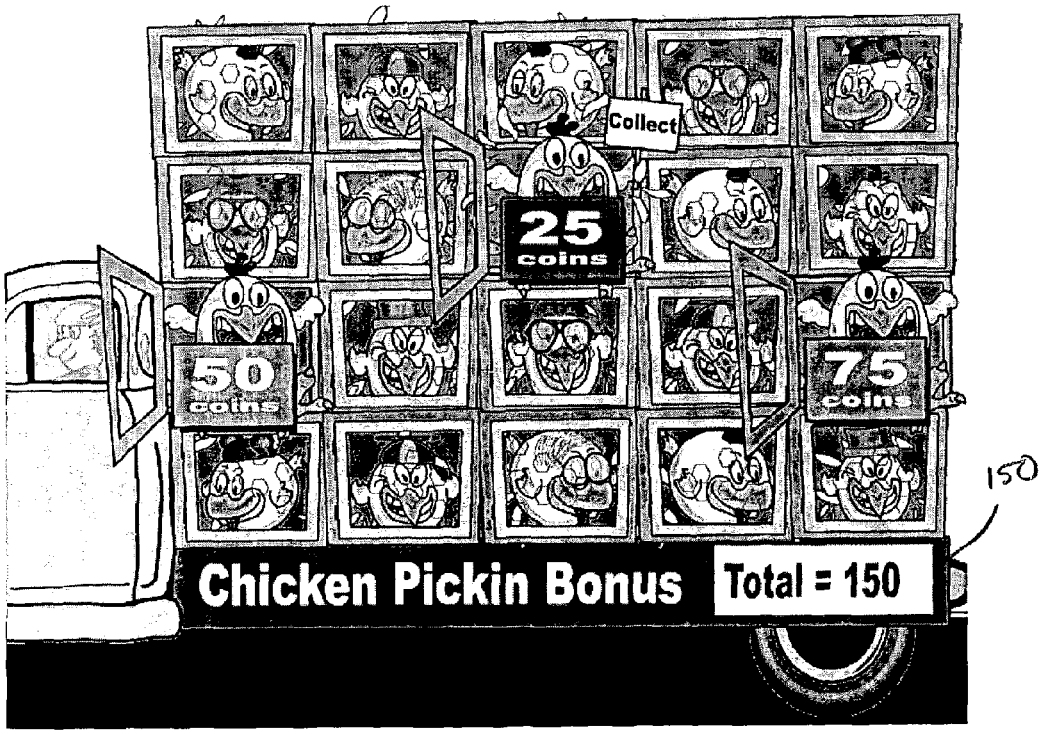

Upon selection of the bonus script in block 130, the bonus display 58 is operated to initially depict an assemblage of selectable elements in block 132 such as those schematically shown in FIG. 14 or pictorially shown in FIG. 18. The following illustrates a sample bonus sequence run according to script #4 in FIG. 13 where the player wagers five coins at a time. That is, the fourth column of FIG. 13 for script #4 indicates that there are three scatter pay sub-steps of ten-times-wager, fifteen-times-wager, and five-times-wager. Multiplied by the five-coin wager by the player, the script results in a 50-coin award, a 75-coin award, and a 25-coin award for a total of 150 coins. The "(S)" symbol next to the five-times-wager amount indicates that award as resulting in a stop-selection outcome as explained more fully below.

FIG. 14 shows a five-by-five grid of selectable elements from A to Y. The gaming machine receives selection of a first one of the twenty-five spaces in block 134 as by a player touching one of the displayed spaces on touch-sensitive screen 58. FIG. 15 illustrates the case where space P is selected. The gaming machine is operated in block 136 to run the first step of the script sequence. Since the script specifies that the first scatter pay award is ten-times-wager, then the amount "50 coins" is displayed within the selected space (block 138). Note that because the script is predetermined, selection of any of the selectable spaces A through Y would have ended with the same result. That is, the step of associated a value with each of the selected one of the elements occurs only after that element has been selected because the gaming machine does not know in advance which element will be selected by the user. Such elements are referred to as nonpredetermined because the elements do not have a value and/or stop-selection flag associated with it until after player selection of the space. The P, H, and T elements in the following example do not have a value associated with them until those spaces are selected. The player, however, is given the illusion that his or her choice affects the amounts awarded within the bonus.

Play proceeds to block 140 where it is determined whether or not the selection results in an end-bonus event. Such an event is called a stop-selection outcome because such a result would prevent the player from selecting additional spaces. The stop-selection outcome occurs at the end of the script sequence—in the case of script #4, after the third selection. Since this is only the first selection within script #4, play proceeds to block 146 where the amount selected and displayed within the grid is displayed within an accumulated bonus meter 150 (FIG. 18). The script proceeds to the next step in block 148 and the gaming machine is placed in idle mode awaiting selection of the next space from bonus grid in block 134. FIG. 16 depicts selection of space T from the grid, resulting in a second award of 75 coins. FIG. 17 depicts selection of space H from the grid, resulting in a third award of 25 coins. But because the third award is also associated with a top-selection outcome (stopper), then the bonus game proceeds to block 142 in FIG. 12 where the total bonus awards from the three spaces are accumulated and the script is ended in block 144.

Other scripts result in different sequences. In script #5, for instance, the script sequence results in selection of only a single space before obtaining a stop-selection outcome. In script #9, the stop-selection outcome results after the thirteenth space selection. The final element selected within the script is always associated with both a value and a stop-selection outcome. The value gives the player a positive feeling about the game outcome despite preventing the player from choosing additional bonus spaces.

The scatter pay amounts shown in FIG. 13 are but one method contemplated for carrying out the invention. In an alternate embodiment, the total bonus amount (column 3) is specified but the scatter amounts are not. Instead, the gaming machine microprocessor 52 operates under an algorithm to operate in one of two ways. In a first way, the microprocessor selects a random or pseudorandom scatter pay amount for each selection up to the total bonus. The script proceeds until the total bonus specified is given out at which point the step-selection outcome is associated with the final space selected. The process can also occur where the number of elements to be selected within the script is determined in advance of the stop-selection outcome as with the preferred embodiment. Once the number of elements is determined, the algorithm can apportion the bonus between each of the elements as those elements are selected.

In another alternate embodiment, the scatter pay amounts are specified but the order is not where the final amount is associated with the stop-selection outcome. Referring back to the example concerning script #4, the order of the three scatter pay amounts can be determined after the bonus game begins so that the first amount awarded can be either the 10-, 15-, or 5-times-wager amount.

One preferred theme for operating a bonus on a gaming machine according to the invention is shown in FIG. 18. The bonus grid is constructed on the display 58 to represent chickens in cages sitting on a truck bed. Play involves choosing chickens where each chicken selected awards a value until a chicken with a stopper and a value is chosen. The animation displayed on screen 58 begins in block 132 of FIG. 12 with a car on the screen from the driver's perspective. The driver pulls up along a truck full of chickens. Once the car is parallel to the truck, the player is instructed to begin picking chickens to win their bonus. The player picks each chicken with a value, until a chicken with a stopper and a value is chosen. This stopper ends the bonus. The chickens may have different personalities that are exhibited throughout the bonus.

Having described and illustrated the principles of the invention in a preferred embodiment thereof, it should be apparent that the invention can be modified in arrangement and detail without departing from such principles. We claim all modifications and variation coming within the spirit and scope of the following claims.

What is claimed is:

1. A method of operating a gaming machine, comprising:

receiving a wager on said gaming machine;

indicating, under control of a processor, a special feature of chance on a visual display, the visual display initially depicting an assemblage of selectable elements;

receiving successive selections of the elements by a player, wherein the value of each selection is determined prior to the element being selected;

associating the determined value of each section with each selected one of the elements after the element has been selected by the player;

ending the special feature upon a stop-selection outcome associated with at least one of the selectable elements;

accumulating the values associated with the elements selected, including the one associated with the stop selection outcome; and awarding a bonus amount based on the accumulated values.

2. The method of claim 1, further including the step of selecting in advance of the selection receiving step a total bonus amount to be awarded.

3. The method of claim 2, further including the steps of:

determining in advance of the selection receiving step the number of elements to be selected until the stop-selection outcome; and apportioning the total bonus amount to be awarded among each of the elements selected.

4. The method of claim 1, further including the steps of:

choosing a bonus based upon a probability and award schedule;

selecting a script to award the bonus, said script including the number of element selection steps until the stop-selection outcome and a value associated with each selection step; and operating the script on the gaming machine.

5. The method of claim 4, wherein the script is selected from a plurality of pregenerated scripts.

6. A method for operating a gaming machine under control of a processor operable in a bonus mode, the method comprising:

determining a total bonus value of a bonus game;

apportioning the total bonus value among successive selections;

displaying on said gaming machine a plurality of selection elements for selection by a player;

receiving element selections made by the player and accumulating the apportioned values associated with the successive selections until the total bonus value has been reached, wherein the value of each selection is determined prior to the element being selected, and wherein the determined value of each selection is associated with the selected element after the element has been selected;

displaying a stop selection outcome with a final selection by the player to reach the total bonus value; and awarding the total bonus value.

7. The method of claim 6 further including selecting a bonus script in advance of the receiving step, said bonus script designating the number of element selection steps to be completed in the bonus mode and the values associated with each selection step where the last such step includes a value and a stop-selection outcome designator.

8. The method of claim 7, wherein the bonus script is selected from a plurality of bonus scripts.

9. A gaming machine controlled by a processor programmed to implement a special feature in response to a wager, the special feature being indicated on a visual display, the gaming machine comprising:

a memory configured to store a plurality of bonus scripts, each bonus script designating a total bonus amount, a total number of selection steps within a bonus sequence, and portions of the total bonus amount to be awarded in each of the selection steps;

script selection means for selecting one of the bonus scripts responsive to the special feature;

a visual display for displaying a plurality of selectable elements valued according to the selected script where each of the selectable elements does not have a value until the element is selected by a player during the special feature; and means for awarding the total bonus amount designated by the script.

10. The gaming machine of claim 9, said script selection means including a probability and award schedule.

11. The gaming machine of claim 9, wherein the portions of the total bonus amount to be awarded in each of the selection steps are randomly associated with each of the selection steps.

12. A gaming device operable in a base mode and a bonus mode, the gaming device comprising:

means for storing a plurality of bonus scripts, each bonus script designating a total bonus amount and a total number of selection steps within a bonus sequence;

script selection means for selecting one of the plurality of bonus scripts responsive to the gaming device entering the bonus mode;

a visual display for displaying a plurality of selectable elements in the bonus mode;

means for receiving a successive selections of the elements from a player;

means for awarding at least a portion of the total bonus amount with each element selected by the player;

means for ending the bonus mode in response to the player's selection of an element corresponding to a final selection of the total number of selection steps specified in the selected script; and means for awarding the total bonus amount designated by the script.

13. The gaming device of claim 12, wherein each of the bonus scripts further designates portions of the total bonus amount corresponding to the total number of selection steps within the bonus sequence.

14. The gaming device of claim 13, wherein each of the portions of the total bonus amount designated in a script directly corresponds to a selection order.

15. The gaming device of claim 13, wherein each of the portions of the total bonus amount designated in a script is randomly assigned to a selection order.

16. The gaming device of claim 12, wherein the portions of the total bonus amount are randomly apportioned to each selection in a selection order so that each selection is associated with a positive value.

* * * * *

UNITED STATES PATENT AND TRADEMARK OFFICE

CERTIFICATE OF CORRECTION

PATENT NO. : 7,530,892 B2
APPLICATION NO. : 10/423727
DATED : May 12, 2009
INVENTOR(S) : Jordan et al.

It is certified that error appears in the above-identified patent and that said Letters Patent is hereby corrected as shown below:

Column 1, beginning on line 20, delete "presents three symbol" and insert therefore --presents three symbols--.

In Claim 1, column 11, line 55, delete "each section with" and insert therefore --each selection with--.

Signed and Sealed this

Twenty-third Day of February, 2010

David J. Kappos

David J. Kappos
*Director of the United States Patent and Trademark Office*